United States Patent [19]

Spivey

[11] 4,340,153

[45] Jul. 20, 1982

[54] METHOD AND APPARATUS FOR MEDICATION DISPENSING

[76] Inventor: David L. Spivey, 11000 SW. 174th Ter., Miami, Fla. 33157

[21] Appl. No.: 211,310

[22] Filed: Nov. 28, 1980

[51] Int. Cl.[3] ..... B67B 7/00; B67D 5/60

[52] U.S. Cl. ..... 222/1; 222/16; 222/131; 222/144.5; 222/145; 222/189; 222/190; 222/309

[58] Field of Search ..... 222/144.5, 145, 137, 222/131, 183, 189, 1, 309, 190, 14, 16, 15; 23/230 A; 73/423 A; 417/441, 503; 128/218 M

[56] References Cited

U.S. PATENT DOCUMENTS

| | | | |
|---|---|---|---|
| 3,127,062 | 3/1964 | Feichtmeir et al. | 222/135 |
| 3,581,575 | 6/1971 | Butler | 222/135 |
| 3,607,094 | 9/1971 | Beer | 23/253 |
| 3,756,456 | 9/1973 | Georgi | 222/14 |
| 3,763,859 | 10/1973 | Yanof et al. | 222/144.5 X |
| 3,817,425 | 6/1974 | Liston | 222/1 |
| 4,011,967 | 3/1977 | Halsey et al. | 222/70 |
| 4,070,156 | 1/1978 | Moran et al. | 23/253 R |
| 4,096,972 | 6/1978 | Bartels et al. | 222/135 |

*Primary Examiner*—Allen N. Knowles
*Attorney, Agent, or Firm*—Jack E. Dominik

[57] ABSTRACT

A method and device is disclosed for aseptically and automatically diluting and dispensing liquids such as medication. The quantities to be delivered are selected, and an electronic circuit translates the selections into sequential and repetitive pumping by syringes comprising part of the device. The syringes are powered by pressurized air, and the entire device is enclosed and supplied with filtered air at a positive pressure to produce aseptic conditions.

9 Claims, 6 Drawing Figures

METHOD AND APPARATUS FOR MEDICATION DISPENSING

BACKGROUND OF THE INVENTION

1. Field of the Invention

The present invention relates generally to the field of dispensing medication, and finds particular utility in connection with the accurate and aseptic diluting and dispensing of respiratory medications. U.S. patent class 222 generally includes dispensing.

2. Description of the Prior Art

The known techniques for diluting liquid medication such as isoetharine with saline for use in respiratory therapy, such as by a nebulizer, are essentially two: either premixed solutions may be purchased in individual vials of the mixing of the medication and the diluent is done by hand. The former technique has little flexibility as to strength of dosage and relatively high cost; whereas the latter technique is prone to human error and contamination.

With respect to various elements of the inventive apparatus, the following prior art is exemplary: U.S. Pat. Nos. 3,607,094; 3,817,425; 4,011,967; and 4,070,156. U.S. Pat. No. 3,607,094 discloses a compressed air actuated piston for delivering a sample. U.S. Pat. No. 3,817,425 discloses syringes which are used to deliver a withdrawn sample and add a reagent to the delivered sample. U.S. Pat. No. 4,070,156 discloses a piston pump which is inserted into a delivery line with one-way valves on either side of the point of insertion. And U.S. Pat. No. 4,011,967 discloses an electronic control system for delivering products in a vending machine.

SUMMARY OF THE INVENTION

The present invention provides a method and apparatus for diluting and dispensing a preselected dosage of liquid medication by electronic control and under aseptic conditions. Compressed air actuated syringes withdraw the preselected amount of medication and diluent and then, again by compressed air actuation, deliver the medication and diluent into an outlet syringe which is removable from the apparatus. The entire cycle of withdrawing and delivering the medication and the diluent is electronically controlled, and the syringes used are disposable so that no fragile and costly metering syringes are required. The entire withdrawing and delivering system is contained under a positive pressure of filtered air to limit air-borne contamination.

In view of the foregoing, it is a principal object of the present invention to provide an apparatus and method for automatically and accurately measuring medication dosages and diluents and delivering the mixed solution while reducing the time, contamination and errors of a technician measuring and diluting by hand.

Another object of the invention is to provide a unique and improved method and electronic device for controlling ingredient dispensing in a medication diluting and dispensing machine.

Another object of the invention is to provide a method and electronic device of the character described which is compact in size yet with which easy to effect ingredient quantity control adjustments are possible both during the initial manufacturing of the machine and after said machine is operational and in the field.

Another object of the invention is to provide a method and device of the character described immediately above which includes a unique circuit means, in the medication dispensing machine environment, having an easily accessable and manipulated control mechanism for metering out desired quantities of ingredients. It is a feature of the invention that the combined circuit means and control mechanism easily lends itself to calibration thereby further simplifying the control over the dispensed product.

Still another object of the present invention is to provide an apparatus and method for lowering the cost of diluting and delivering medications by reducing the technician time required, allowing the purchase of bulk diluent, and lessening the waste of medication.

Still a further object of the present invention is to provide an apparatus which is not fragile but is easy to disassemble and disinfect.

BRIEF DESCRIPTION OF THE DRAWINGS

The foregoing objects and advantages of the present invention will be more fully understood as the following description of a preferred apparatus proceeds, taken in conjunction with the accompanying drawings, in which:

FIGS. 3A and 3B are portions of the detailed schematic diagram of the electronic control.

THE METHOD

The inventive method comprises the steps of selecting the desired quantities of the desired liquids, activating an appropriate electronic circuit which automatically controls an external power source to sequentially and repetitively pump disposable syringes which are connected to sources of the desired liquids and thereby to deliver said desired quantities to an outlet container, and providing an enclosure for all of said devices so that aseptic conditions may easily be established by disassembly and disinfecting and be maintained by introducing a positive pressure of filtered air into said enclosure.

DESCRIPTION OF THE PREFERRED EMBODIMENT

Figure 1:
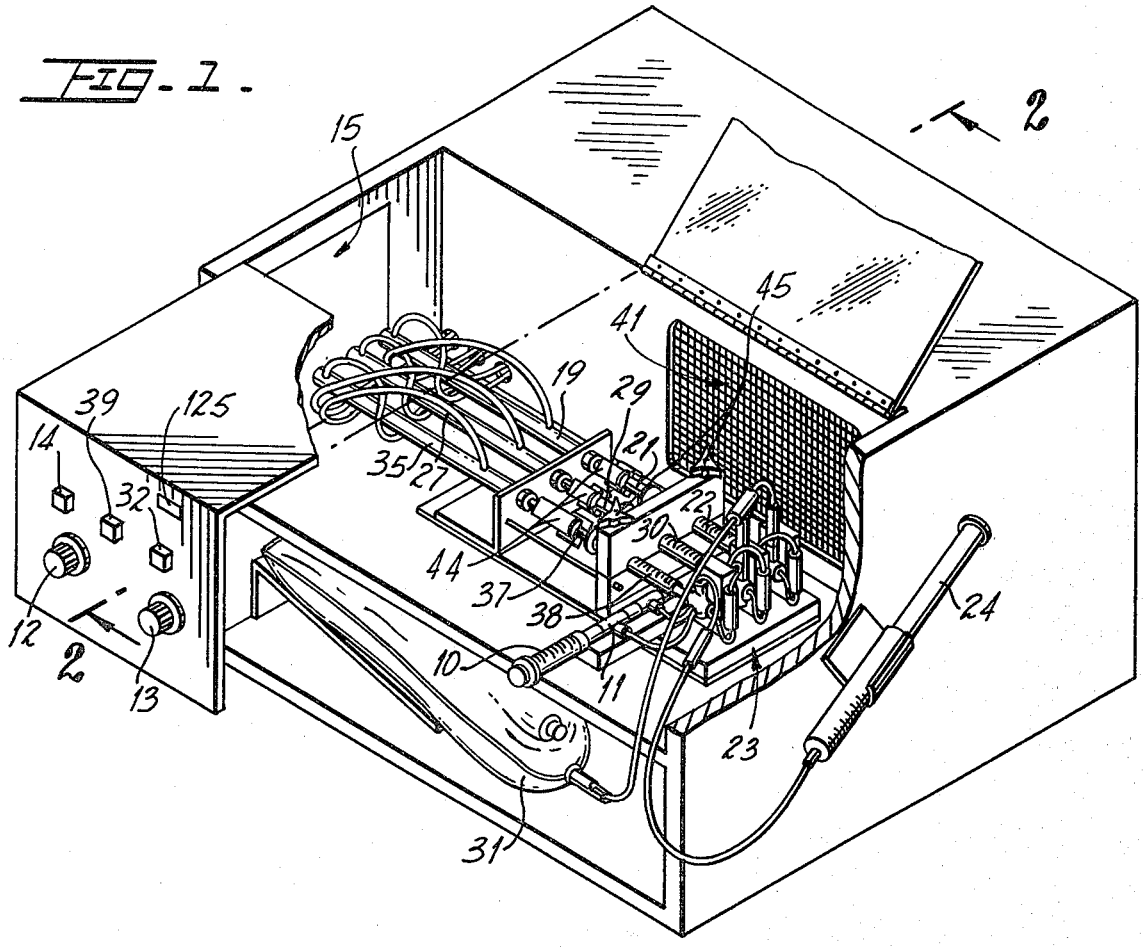
FIG. 1 is a perspective broken partially sectioned view of the apparatus.
Figure 2:
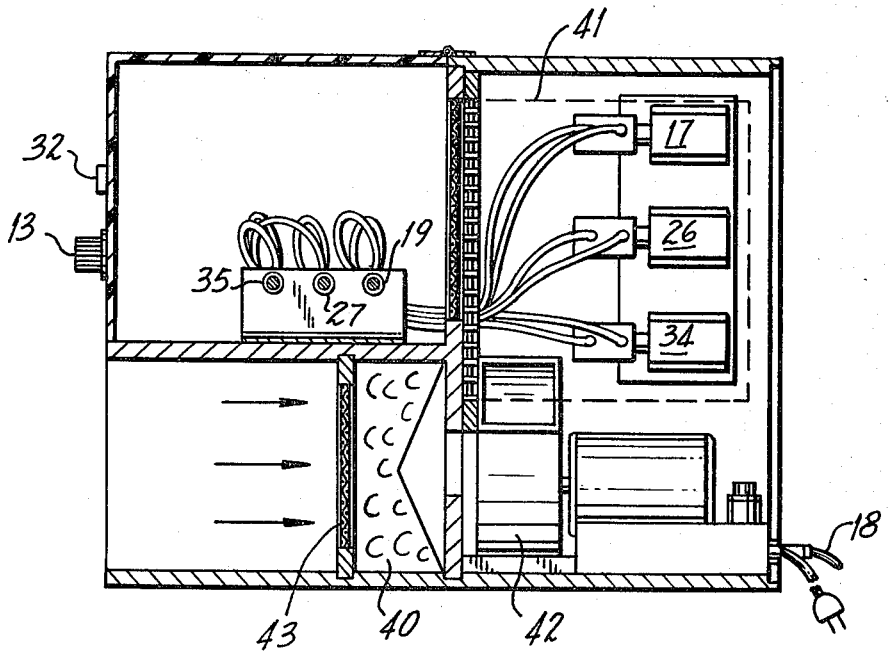
FIG. 2 is a cross-sectional view of the apparatus.
Figures 3, 3A:
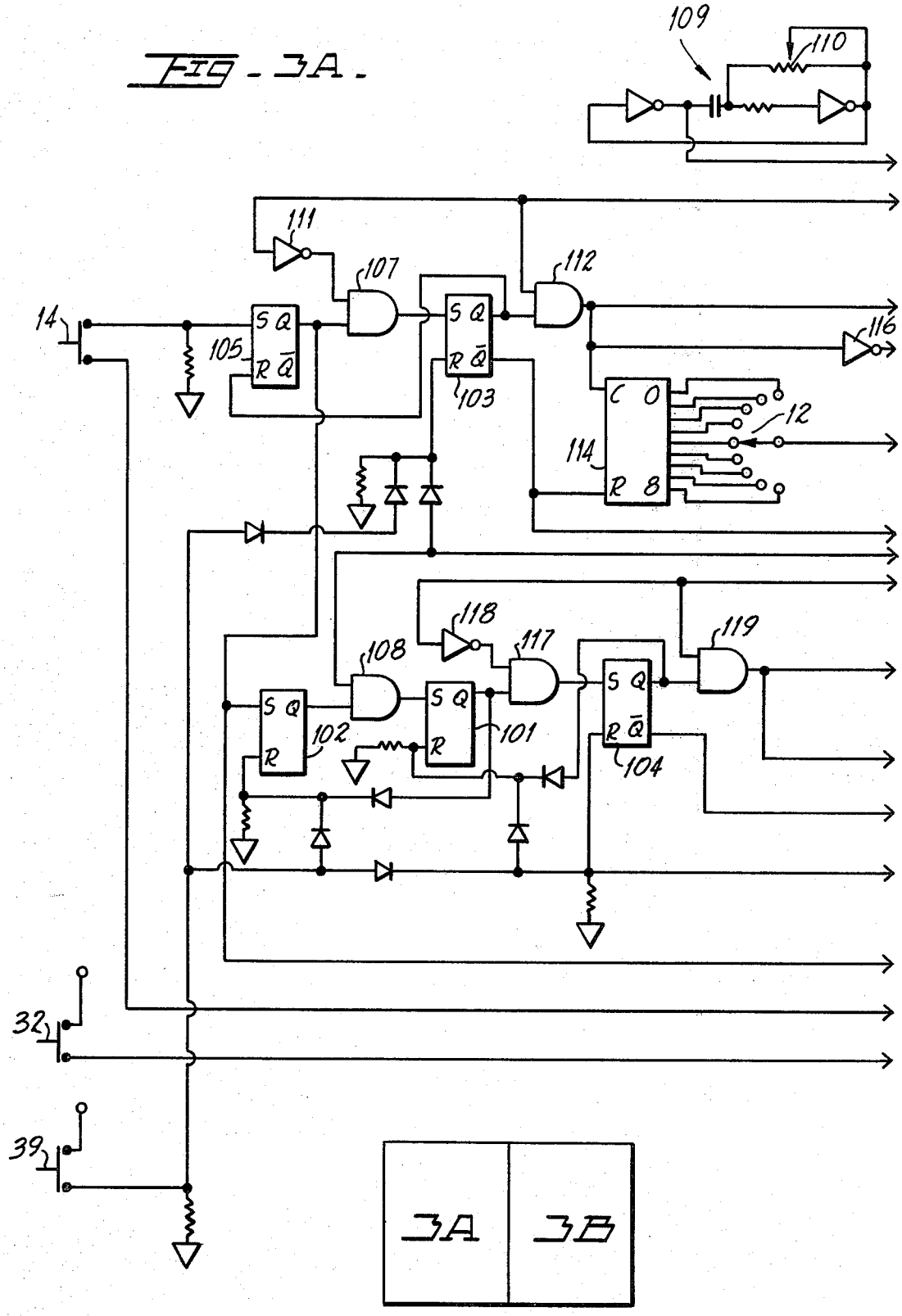
FIG. 3 shows how
FIGS. 3A and 3B are to be arranged for proper viewing.
Figure 3B:
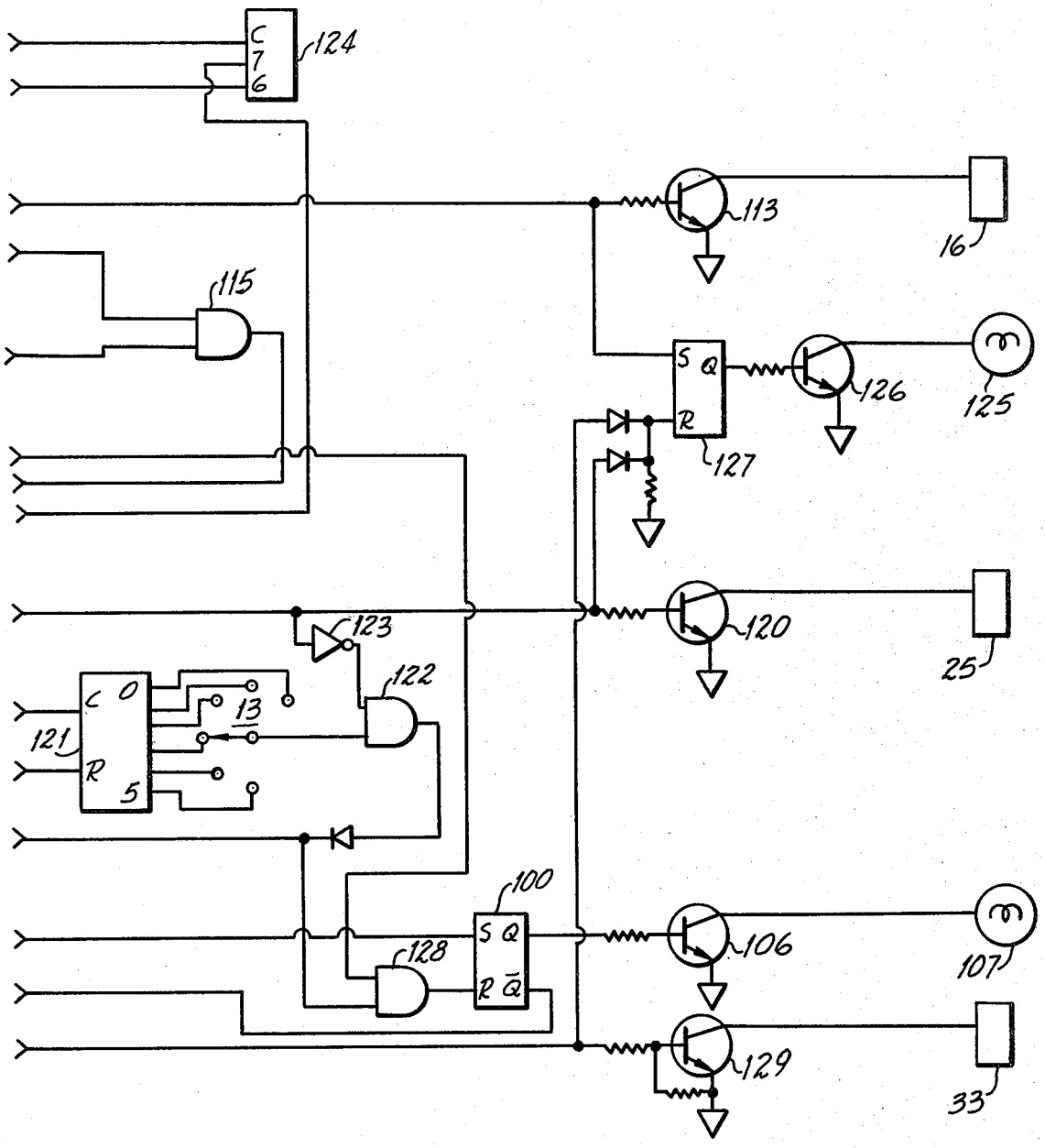
Figure 4:
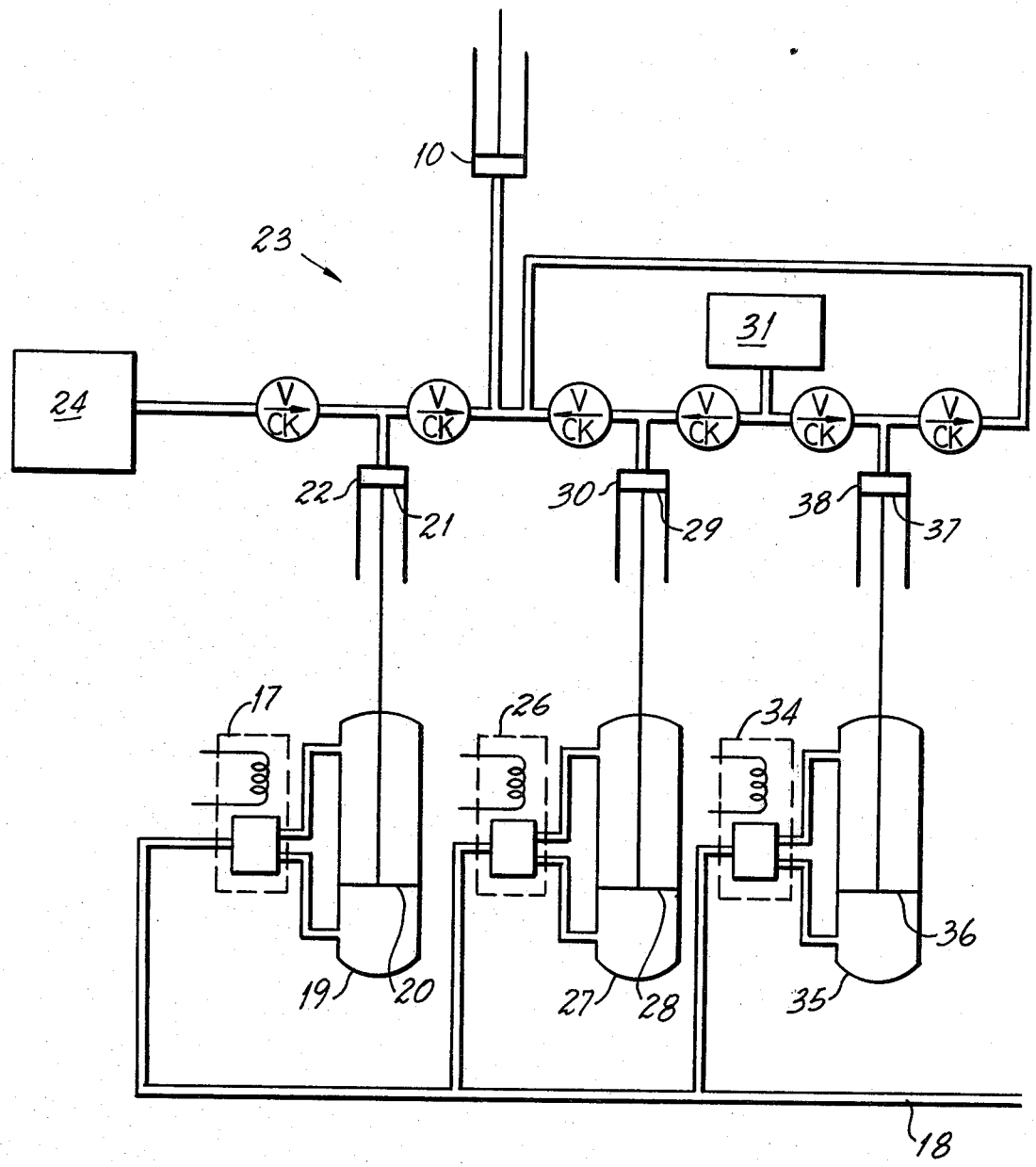
FIG. 4 is a schematic diagram of the fluid flows.

As shown in FIG. 1, the outlet syringe 10 which is to receive the diluted medication is inserted into mounting 11. The number of drops of medication is then selected by adjusting switch 12, and the number of cubic centimeters of diluent, such as saline, is selected by adjusting switch 13. The start button 14 is then depressed which begins the automatic electronic control cycle. As will be described in detail later, the electronic control circuit, generally designated as 15, first produces a pulse which activates relay 16 to energize solenoid valve 17 connecting external standard high pressure air line 18 to the extension inlet of air cylinder 19. Air cylinder 19 may be of type 9SD with a 4 inch stroke, and solenoid valve 17 may be a combination of a solenoid of type AVSC-115 and a 4-way control valve of type MAV-4, all as manufactured by Clippard. Air line 18 provides air at approximately 50 psi. This causes piston 20 (the connecting rod portion) to extend from cylinder 19 and press the plunger 21 into syringe 22 thereby forcing out one drop of medication past a one-way valve in manifold 23 and into outlet syringe 10. Syringe 22 may be a Monoject 1 cc tuberculine syringe and syringe 10 may be any standard syringe with a capacity sufficient to accept the volume to be delivered. At the end of said pulse, after the drop of medication has been forced out of the syringe 22, the relay 16 is deactivated and valve 17 disconnects the air line 18 from the extension inlet of cylinder 19 and connects the air line 18 to the retraction inlet of cylinder 19 so that piston 20 is forced back into cylinder 19. The plunger 21, which is connected to piston 20, is thereby partially withdrawn from syringe 22 and this causes medication from bulk storage container 24 to be drawn past a one-way valve into syringe 22. This cycle of activating relay 16 and forcing a drop of medication from syringe 22 and then deactivating relay 16 so as to reload syringe 22, is automatically repeated for as many drops as were selected by the setting of switch 12.

After the selected number of drops of medication have been delivered, the circuit 15 supplies a pulse to relay 25 which causes solenoid valve 26 to connect air line 18 to the extension inlet of air cylinder 27 and thereby extend piston 28 from cylinder 27. The extension of piston 28 forces the plunger 29 into syringe 30 and forces 1 cc of saline past a one-way valve in manifold 23 and into outlet syringe 10; this flow of saline also sweeps any medication that remained in manifold 23 after the medication delivery cycle out into outlet syringe 10. Syringe 30 may be a Monoject 6 cc syringe. Also, by the use of dye, it has been observed that the mixing of the medication and the saline in outlet syringe 10 is quite good. When relay 25 is deactivated, valve 26 disconnects the air line 18 from the extension inlet of cylinder 27 and connects it to the retraction inlet of cylinder 27 which causes piston 28 to withdraw into cylinder 27. The plunger 29 is connected to piston 28 and is thereby partially withdrawn from syringe 30. This causes saline from bulk storage container 31 to flow past a one-way valve into syringe 30. This cycle of forcing 1 cc of saline out of syringe 30 and into manifold 23 and from there into outlet syringe 10 followed by the reloading of syringe 30 from the bulk storage container 31, is automatically repeated for as many cc's of saline as were selected by the setting of switch 13. This completes the automatic delivery of the selected dosage of medication and diluent, and the apparatus resets for the next use.

Additionally there is provided a separate circuit for delivery of 5 cc of diluent without any medication. Pushbutton 32 when depressed, activates relay 33 to cause solenoid valve 34 to connect the air line 18 to the extension inlet of air cylinder 35 and thereby extending piston 36 from cylinder 35 and pushing the plunger 37 into the body of syringe 38. Syringe 38 may be a Monoject 6 cc syringe. This causes 5 cc of saline to be forced into manifold 23 and out into outlet syringe 10. Relay 33 is then deactivated and valve 34 disconnects air line 18 from the extension inlet of cylinder 35 and connects it to the retraction inlet of cylinder 35. This causes piston 36 to withdraw into cylinder 35 and pulls the plunger 37 partially out from syringe 38 thereby withdrawing saline from bulk container 31 through manifold 23 into syringe 38.

There is also provided a subcircuit for stopping the automatic cycle prior to completion. Pushbutton 39, when depressed, stops the automatic cycle of dispensing into outlet syringe 10 and reloads, as the case may be, the syringes 22, 30 and 38 and thereby resets the apparatus for the next use. Pushbutton 39 may also be used as an initial aligning of the apparatus after electrical and air power are first applied.

To provide for aseptic conditions around the manifold and syringes, air is drawn in through dust filter 43 and copper wool filter 40 and forced by blower 42 through a high efficiency particulate air filter 41 and then into the chamber containing the syringes and manifold. Thus a positive pressure of filtered air is provided for the chamber containing the syringes and manifold. The high efficiency particulate air filter 41 may be of type No. 459217 HEPA filter, as manufactured by Mine Safety and Appliance, which traps 99.9% of all particles of more than 0.3 micron diameter.

The connectors, generally noted by 44, which connect piston 20 to syringe plunger 21, piston 28 to syringe plunger 29, and piston 36 to syringe plunger 37 are adjustably attached to the pistons so that calibration may be easily performed. Further, the manifold 23 may be easily disassembled for cleaning and disinfection. In particular, wing nut 45 unscrew so as to release syringes 22, 30 and 38.

A power supply converts the standard 115 volts AC to a regulated 12 volts DC for powering control circuit 15. The solenoid valves operate on standard 115 volts AC.

The electronic control circuit 15 operates as follows: The circuit is reset and ready for operation, as may be achieved by closing pushbutton 39, by causing the reset input of flip-flops 100–104 to go high. Flip-flops 100–104 are integrated circuits of type 4013.

Pressing pushbutton 14 inputs the high not-Q output of flip-flop 100 into the set input of flip-flop 105. Flip-flop 105 is an integrated circuit of type 4013. The high set input into flip-flop 105 causes the Q output to go high which is fed into set input of flip-flop 100 and this causes the not-Q output of flip-flop 100 to go low and disable switch 14 for the remainder of the automatic cycle. The high Q output of flip-flop 100 turns on transistor 106 and thus also lamp 107 which is the indicator lamp behind pushbutton 14 and shows that the cycle is in process. Transistor 106 is of type 2N2222. The high Q output of flip-flop 105 is also fed into AND-gate 107 and the set input of flip-flop 102, this causes the Q output of flip-flop 102 to go high and this is fed into AND-gate 108.

Pulse generator 109 outputs a square wave, whose frequency may be adjusted by variable resistor 110, into ripple counter 124 which divides the frequency of the square wave and outputs square waves of approximately 2Hz and 1Hz. Ripple counter 124 is an integrated circuit of type 4024. The 2Hz square wave will be called the First Clock and the 1Hz square wave the Second Clock. The First Clock pulses are inverted by inverting amplifier 111 and fed into AND-gate 107. Thus the high Q output of flip-flop 105 will pass through AND-gate 107 between First Clock pulses and set flip-flop 103. The high Q output of flip-flop 103 will now reset flip-flop 105 and also be fed into AND-gate 112. The next pulse of the First Clock will now pass through AND-gate 112 and turn on transistor 113 and thereby activate relay 16 for the duration of the First Clock pulse. As previously described, activating relay 16 causes the medication in syringe 22 to be forced into manifold 23 and on into outlet syringe 10. The First Clock pulse passing through AND-gate 112 is also fed into decade counter/decoder 114 at the clock input. Counter 114 is an integrated circuit of the type 4017 and sequentially makes the ten outputs go high with all others staying low in response to clock pulses. The outputs of counter 114 are connected to selector switch 12 so that the output corresponding to the selected number of drops of medication is connected to an input of AND-gate 115 whereas all other outputs of counter 114 are open. Thus, for example if selector switch 12 is set at four drops, the fourth First Clock pulse through AND-gate 112 will cause counter 114 to feed a high signal into AND-gate 115 which will persist until the fifth First Clock pulse is inputted into counter 114. The First Clock pulses passing through AND-gate 112 are inverted by inverting amplifier 116 and fed into AND-gate 115. Thus AND-gate 115 has a low output until the completion of the pulse corresponding to the setting of selector switch 12, and at the end of this pulse the output of AND-gate 115 goes high and resets flip-flop 103 and makes the output of AND-gate 108 go high thereby setting flip-flop 101. The high not-Q output of flip-flop 103 resets connector/decoder 114 to zero and feeds into AND-gate 128, and the low Q output of flip-flop 103 makes AND-gate 112 block any more First Clock pulses from passing and so turns off transistor 113, completing the medication delivery cycle. The setting of flip-flop 101 causes its Q output to go high which resets flip-flop 102 and which also feeds into AND-Gate 117 for beginning the diluent delivery cycle.

The Second Clock pulses are inverted by inverting amplifier 118 and fed into AND-gate 117. Thus the high Q output of flip-flop 101 will pass through AND-gate 117 between Second Clock pulses and set flip-flop 104. The high Q output of flip-flop 104 will now reset flip-flop 101 and also be fed into AND-gate 119. The next pulse of the Second Clock will now pass through AND-gate 119 and turn on transistor 120 and thereby activate relay 25 for the duration of the Second Clock pulse. As previously described activating relay 25 causes the diluent in syringe 30 to be forced into manifold 23 and on into outlet syringe 10. The Second Clock pulse passing through AND-gate 119 is also fed into decade counter/decoder 121 at the clock input. Counter 121 is an integrated circuit of type 4017 and sequentially makes the ten outputs to high with all others staying low in response to clock pulses. The outputs of counter 121 are connected to selector switch 13 so that the output corresponding to the selected number of cc's of diluent is connected to an input of AND-gate 122 whereas all other outputs of counter 121 are open. Thus, for example, if selector switch 13 is set at 3 cc, the third Second Clock pulse through AND-gate 119 will cause counter 121 to feed a high signal into AND-gate 122 which will persist until the fourth Second Clock pulse is inputted into counter 121. The Second Clock pulses passing through AND-gate 119 are inverted by inverting amplifier 123 and are fed into AND-gate 122. Thus AND-gate 122 has a low output until the completion of the pulse corresponding to the setting of selector switch 13, and at the end of this pulse the output of AND-gate 122 goes high and resets flip-flop 104 which makes AND-gate 119 blocking any more Second Clock pulses from passing and so turns off transistor 120, completing the diluent delivery cycle. The output of AND-gate 122 also passes through AND-gate 128 and resets flip-flop 100 and thereby bringing its high not-Q output to push-button 14 for system start and the low Q output turn off transistor 106 and thus also turns off lamp 107 thereby thereby showing the completion of the delivery cycle.

There is also provided a light-emitting diode 125 to indicate the presence of medication in the manifold which has not been flushed out by the diluent; thus the light-emitting diode 125 will be glowing during the medication cycle but not during the diluent cycle. This is important information if the automatic cycle is interrupted, such as by activation of pushbutton 39, because the reset or resting condition for the apparatus is to have diluent in the manifold. Light-emitting diode 125 glows when transistor 126 is conducting, which is when flip-flop 127 has been set. Flip-flop 127 is set by First Clock pulses that pass AND-gate 112, and is reset by either Second Clock pulses that pass AND-gate 119 or activation of pushbutton 32, which is the delivery of 5 cc of diluent cycle initiator.

From the foregoing, it will be seen that this invention is one well adapted to attain all of the ends and objects herein set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matters herein setforth or shown in the accompanying drawings is to be interpreted as illustrative and not in a limited sense.

Having described my invention, I claim:

1. A device for automatic mixing and dispensing of preselected quantities of liquids in an aseptic environment, comprising:

a source of said liquids, a plurality of selection means for inputting said preselections, a plurality of cylinders, each containing a piston which moves longitudinally within said cylinder, and each of said cylinders corresponding to a particular one of said selection means, a plurality of syringes, each containing a plunger, and each of said syringes corresponding to a particular one of said cylinders, a plurality of adjustable connectors, each of said connectors corresponding to a particular one of said cylinders and connecting said corresponding syringe plunger to said corresponding piston, so that longitudinal movement by said piston within said cylinder causes longitudinal movement of said plunger within said syringe, a manifold for directing the output of each of said syringes into a common output, supply means for supplying each of said syringes with one of said liquids from said source, a plurality of valve means, each of said valve means corresponding to one of said cylinders and connected thereto for introducing and exhausting pressurized fluid from external source to said cylinder so as to cause said piston and said corresponding plunger to be longitudinally moved, control means interconnecting said valve means and said selection means for sequentially and repetitively activating each of said valve means for a determined time period a number of times correlated to said preselection inputted into said corresponding selection means, an enclosure to contain said cylinders, syringes, manifold, connecting, supply means, valve means, and control means, and filter and blower means whereby ambient air is filtered to remove infectious bodies and drawn into said enclosure thereby providing a positive pressure of aseptic air.

2. The device as defined in claim 1, wherein said control means comprises:

a source of electrical power, a pulse generator, a plurality of pulse counters, each of said pulse counters corresponding to a particular one of said selection means, means interconnecting said selection means, said pulse counters, said pulse generator, and said valve means for sequentially activating each one of said valve means repetitively so that during each pulse outputted by said pulse generator if the total number of pulses outputted and counted by said corresponding pulse counter has not exceeded the preselected total as determined by the preselection inputted into said corresponding selection means, said valve means is activated, and reset means for clearing the count totals in said pulse counters prior to initiation of the automatic delivery and mixing cycle.

3. The device as defined in claim 1, wherein said pressurized fluid is air at a pressure between 10 pounds per square inch and 200 pounds per square inch, said cylinders are double acting air cylinders, and said valve means comprises solenoid-activated four-way high pressure air valves.

4. The device as defined in claim 1, wherein said syringes are disposable syringes, and said common output is the orifice of a syringe.

5. The device as defined in claim 1, wherein said filter and blower means comprises an electric air blower, a dust filter, a copper wool filter, and a high efficiency particulate air filter which traps virtually all air borne particles of diameter exceeding 0.3 microns.

6. The device as defined in claim 1, wherein said syringes, manifold, and supply means are easily disassemblable thereby facilitating cleaning and disinfecting.

7. The device as defined in claim 1, wherein:

said selection means are multiposition switches.

8. A method for aseptically and automatically mixing and dispensing preselected quantities of liquids comprising the steps of:

providing a source of said liquids, providing a plurality of syringes, at least one of said syringes corresponding to and in communication with each of said liquids, providing a plurality of selection means for inputting said preselection, each of said selection means corresponding to a particular one of said syringes, providing a manifold to direct the output of each of said syringes to a common output, providing a control means interconnecting said syringes and said selection means for sequentially pumping each of said syringes to deliver said preselected quantities, and providing an enclosure to contain said syringes and control means equipped with a filter and blower means for filtering and introducing ambient air into said enclosure whereby a positive pressure of aseptic air is maintained within said enclosure.

9. The method defined in claim 8, wherein:

said syringes are standard disposable syringes.

* * * * *